United States Patent [19]

Bunin

[11] 4,094,092

[45] June 13, 1978

[54] TWO DIMENSIONAL ANIMATED CHARACTER

[75] Inventor: Morey Bunin, New York, N.Y.

[73] Assignee: Aniforms, Inc., New York, N.Y.

[21] Appl. No.: 559,013

[22] Filed: Mar. 17, 1975

[51] Int. Cl.[2] ..... A63H 7/00

[52] U.S. Cl. ..... 46/126; 40/425

[58] Field of Search ..... 46/126, 135 R, 129, 46/123, 124, 118, 119; 40/106.41, 106.42, 106.43, 67, 1.5

[56] References Cited

U.S. PATENT DOCUMENTS

| | | | |
|---|---|---|---|
| 1,267,807 | 5/1918 | Schisgall | 46/135 R |
| 2,295,430 | 9/1942 | Seewald | 40/106.41 |
| 2,444,169 | 6/1948 | Paige | 46/126 |
| 2,694,873 | 11/1954 | Francis | 40/67 |

FOREIGN PATENT DOCUMENTS

| | | | |
|---|---|---|---|
| 448,764 | 3/1935 | United Kingdom | 40/106.43 |

*Primary Examiner*—F. Barry Shay

[57] ABSTRACT

A two dimensional animated character providing a wide range of movements and controls for the eyeballs, eyelids and mouth by means of vertical control rods and connecting linkage and hinge mechanisms. Movement of the eyeballs in a left to right and up and down direction is produced by means of a pivotally mounted background plate having the eyeball features fixed thereon. The eyeball background plate is connected to the lower ends of a pair of control rods which manipulate such plate so that the eyeballs move in a general arc path to the left and right, and up and down. The eyelids are animated by an upper and lower plate simulating eyelid features. The upper and lower plates are each connected to the lower ends of vertical control rods which in turn are pivotally connected to opposite ends of a pivotally mounted bar. In operation, the downward displacement of one eyelid control rod causes the upper eyelid feature to be lowered and, this same displacement causes the bar to pivot and displace the other control rod upwardly, thereby raising the lower eyelid feature in unison with the lowering of the upper eyelid feature. Animation of the mouth is provided by a pair of semicircular disks which are hinged together at one end such that the disks can be fully opened to their widest position to expose the broadest mouth feature located behind the disks. One further feature is a flexible arm comprised of a strip of rubber extending the length of the character's arm with a plurality of short strips of flexible material alternately attached in crosswise fashion on the front and back sides of the rubber strip.

This crossweave of the flexible material accomodates the bending movements of the rubber strip when simulation of the arm and hand movement is produced by a control means attached to the hand.

9 Claims, 9 Drawing Figures

Fig. 1.
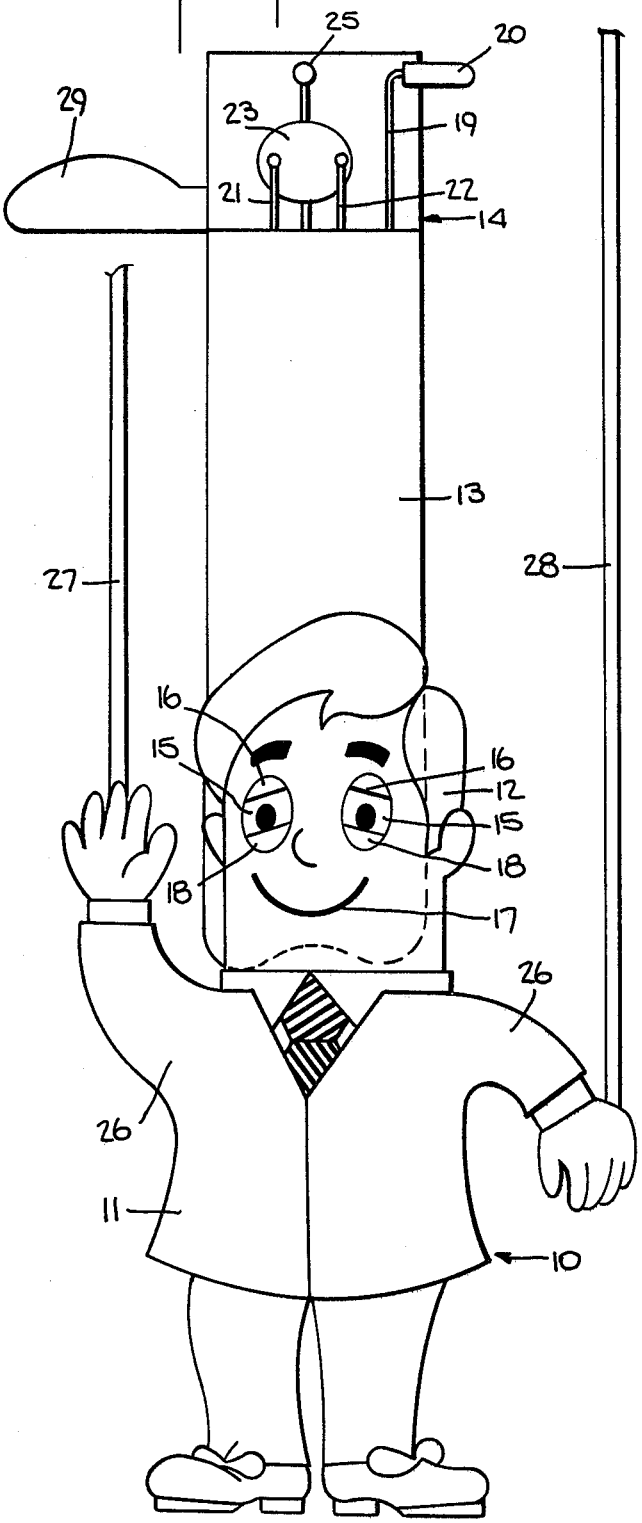
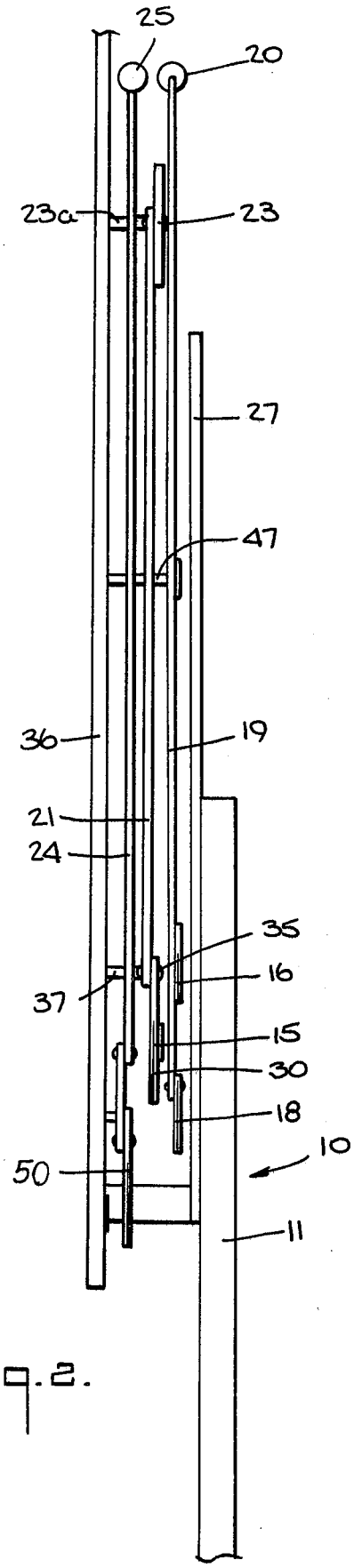
Fig. 2.

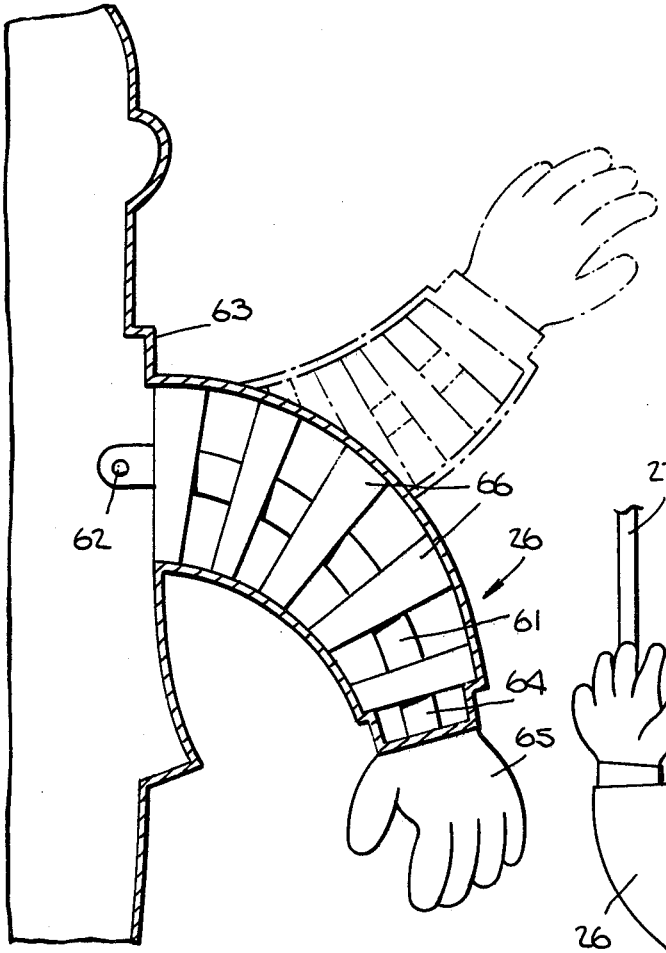
Fig. 8.
Fig. 7.
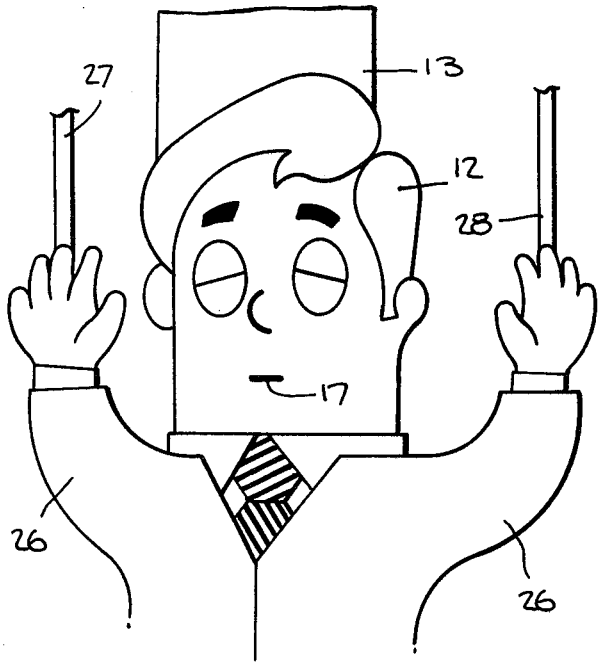
Fig. 9.
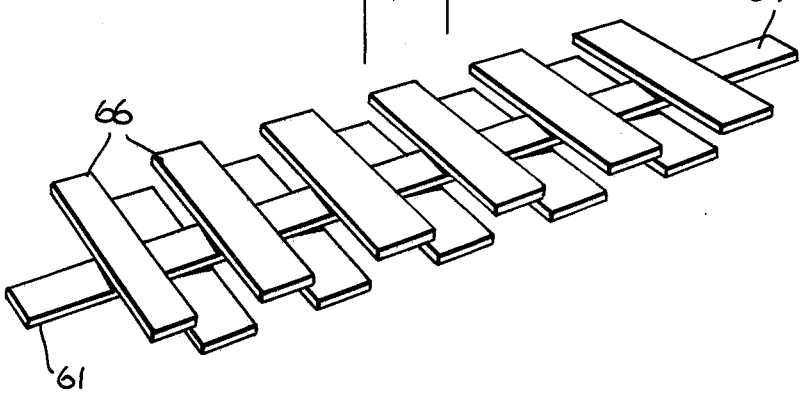

TWO DIMENSIONAL ANIMATED CHARACTER

BACKGROUND OF THE INVENTION

The present invention relates to two dimensional animated figures, and more particularly to the methods and devices for moving various parts of the figures.

Animated two dimensional puppets have been employed in the motion picture film and television industries for making cartoons. The known mechanism for controlling features such as the eyes, the mouth, the arms and the fingers are generally complex or difficult to manipulate. Also, the movement of the features is often so limited that the desired impression of the features of the character is not achieved.

SUMMARY OF THE INVENTION

It is an object of the present invention to provide a two dimensional animated character with a wide range of movements of the character features. It is another object to provide simple and easily manipulated mechanisms for controlling movable features of the character.

These and other objects are achieved by the present invention which provides a two dimensional animated character producing a wide range of link and hinge mechanisms associated with manually operable control rods. Movement of the eyeballs in a left to right and up and down direction is produced by means of a pivotally mounted background plate having the eyeball features fixed thereon in an appropriate spaced apart relation. The eyeball background plate is connected to the lower ends of a pair of control rods which pivotally manipulate the eyeball background plate. The eyeball control rods are attached at their upper end to a handle which pivots the background plate to move the eyeballs in a general arc path from left to right, and up and down.

The eyelid features are animated by an upper and a lower plate which are controlled for up and down movement to simulate the opening and closing of the eyes. The upper eyelid plate is connected to the lower end of a first vertical control rod, and the lower eyelid plate is connected to the lower end of a second vertical control rod. The first vertical control rod is operatively connected to the second vertical control rod by a rigid bar having a pair of pivot slots which respectively receive a pivot arm extending from each of the first and second control rods. The rigid bar is pivotally attached near its central portion to a fixed pivot pin that is attached to the support structure for the controls. The rigid link is pivotally connected to each of the first and second vertical control rods at a point near the middle of such rods directly above the eyelid features. In operation, the downward displacement of the first control rod causes the upper eyelid feature to be lowered. This same movement of the first control rod causes the rigid bar to pivot about the fixed pivot pin and raise the second control rod thereby raising the lower eyelid feature in unison with the lowering of the upper eyelid feature.

The mouth feature is produced by a paint or other material forming the shape of a mouth on a background plate. Animation of the mouth is provided by a pair of semi-circular disks which are pivotally mounted in front of the mouth on a common pivot pin. The disks can be fully opened to their widest position to expose the broadest mouth feature, or alternately, the disks can be pivotally closed to expose a smaller section of the mouth feature. A link is pivotally connected from each of the disks to the lower end of a vertical control rod so that the up and down movement of the control rod causes each of the links to pivot its respective disk about the pivot pin and thereby expose from a small section to a large section of the mouth feature to simulate a broad smile.

A flexible arm is comprised of a strip of rubber secured at one end to the shoulder portion of the character's body while its other end extends into the characters hand. The strip of rubber has attached to it a plurality of short strips of flexible material which are alternately attached in crosswise fashion on the front and back sides of the rubber strip. This crossweave of the flexible material accomodates the bending movements of the rubber strips when simulation of the arm and hand movement is produced by a control means attached to the hand.

BRIEF DESCRIPTION OF THE DRAWINGS

FIG. 1 is a front elevation of a two dimensional animated character, illustrative of the present invention;

FIG. 2 is a side elevation of the mechanism shown in FIG. 1;

FIG. 7 is a fragmentary front elevation of the character shown in FIG. 1 depicting one arrangement of the facial features and arms of the character shown in FIG. 1;

FIG. 8 is an enlarged fragmentary front elevation of an arm of the character shown in FIG. 1; and FIG. 9 is an enlarged isometric view of the flexible arm structure shown in FIG. 8.

DESCRIPTION OF THE PREFERRED EMBODIMENT

Figure 3:
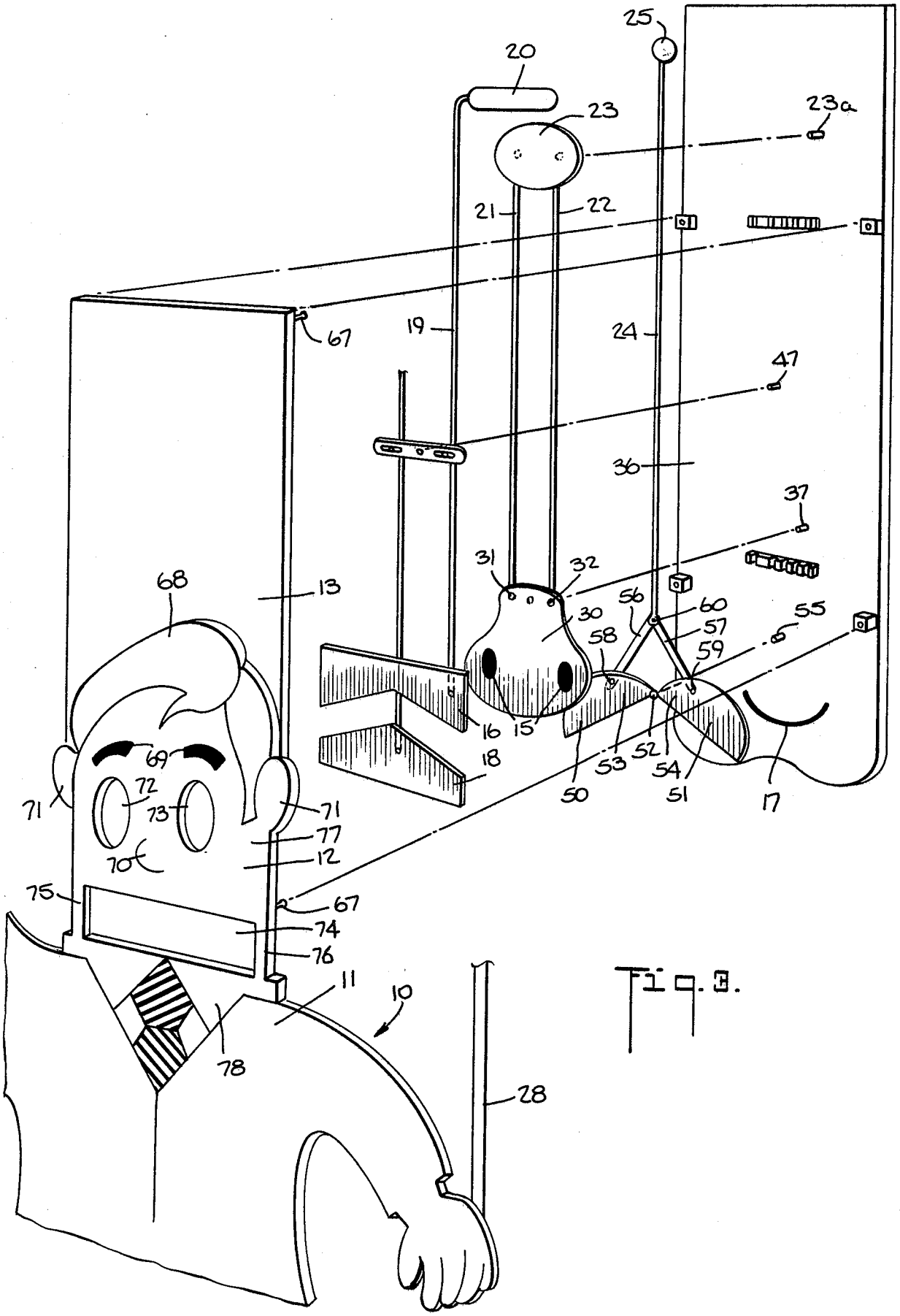
FIG. 3 is a front enlarged exploded isometric view of the mechanism shown in FIG. 1.

Referring to FIGS. 1 and 3 there is shown a front elevation of the overall character and control mechanism 10 which includes the character body 11, the head and facial portion 12 and the front plate 13 covering the lower extensions of the control mechanisms 1 for moving the eyeballs 15, eyelids 16 and the exposure of the mouth feature 17. More particularly, a pair of upper eyelids 16 and a pair of lower eyelids 18 are movable up and down as viewed in FIG. 1 to open and close by means of an eyelid control rod 19 which is manipulated generally vertically by a handle 20 (see also FIG. 2). A pair of eyeballs 15 is moved in several directions by means of eyeball control rods 21 and 22 attached to a handle 23. Mouth feature 17 is varied in its amount of lateral display by vertically movable control rod 24 by means of a handle 25. Each of the arms 26 of the character 10 includes a flexible construction as shown in FIGS. 7–9 inclusive, for manipulation thereof and being controlled by respective rods 27,28. The front cover plate 13 may be comprised of a board which is painted or covered with a material providing a suitable background effect as will be described hereinafter. Main support handle 29 is provided at the upper end of the entire structure for manually supporting the apparatus on one hand of the operator while the other hand is used to manipulate the control mechanisms just described.

Figure 5:
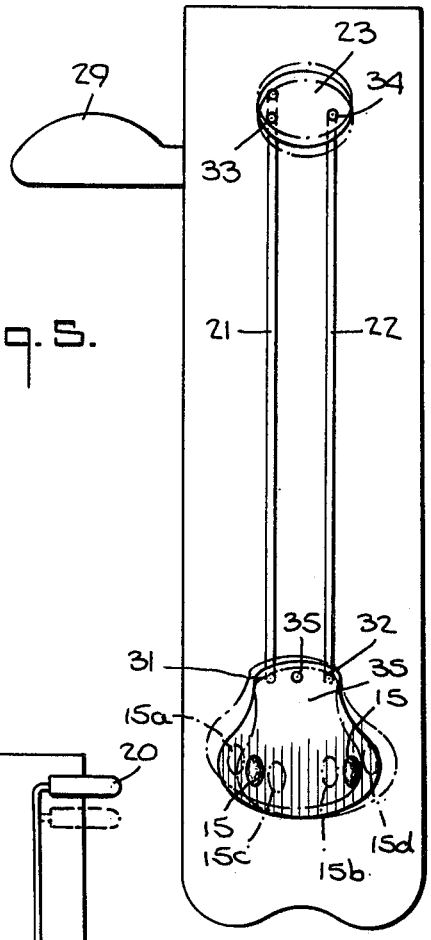
FIG. 5 is a front elevation of the mechanism for controlling the eyeballs of the character shown in FIG. 1.

Referring to FIG. 5 there is shown the mechanism for controlling the eyeballs 15 of the character 10. The eyeballs 15 are provided by either a paint or circular shaped material which is attached to a background plate 30. The background plate 30 may be painted either white or with a color that produces a transparent type of effect. The background plate 30 is connected by pivot pins 31 and 32 to respective eyeball control rods 21 and 22. Control rods 21 and 22 are connected at their upper ends to the eyeball control handle 23 by means of respective pivot pins 33 and 34. Control handle 23 is pivotally mounted to post 23*a*. As shown in FIG. 2, pivot pin 35, pivotally mounting background plate 30, is fixedly mounted on a rear support plate 36 by means of a support post 37 which is either attached to or forms a part of the pivot pin 35.

In operation, the handle 23 can be moved to pivot the background plate 30 via control rods 21 and 22 so that the plate 30 swings eyeballs 15 into the positions shown by the dotted lines 15*a* and 15*b* or the positions indicated by dotted lines 15*c* and 15*d*. This eyeball effect is produced when the background plate 30 swings about the pivot pin 35 into the positions shown by dotted lines on FIG. 5. The positions of the eyeball control handle 23 are shown by the adjacent dotted lines. In this fashion, the eyeballs move in a generally arcuate path from left to right and up and down.

Figure 6:
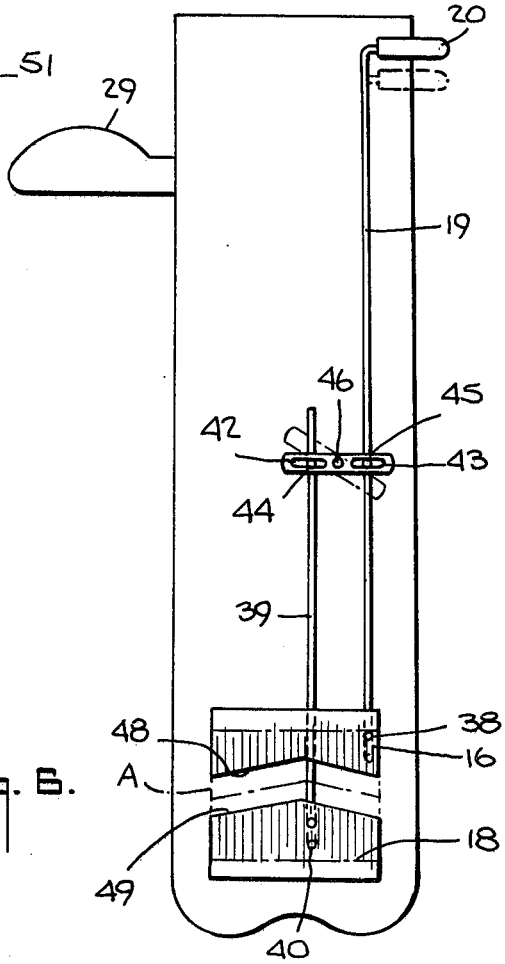
FIG. 6 is a front elevation of the mechanism for controlling the eyelids of the character shown in FIG. 1.

Referring to FIG. 6, there is shown the mechanism for controlling the eyelids 16 and 18. The eyelid control rod 19 is attached to the upper eyelid 16 by means of pin 38 on the rod 19. A second control rod 39 is attached to the plate forming the lower eyelid 18 by means of a pin 40. Control rod 19 is operatively connected to the control rod 39 by means of an interconnecting link 41 which is provided with a pair of slots 42 and 43 respectively receiving pivot pins 44 and 45 attached to respective control rods 39 and 19. Link 41 is pivotally connected to a fixed pivot pin 46 which in turn is fixedly attached to the rear support plate 36 by means of a support arm 47 (see also FIG. 3).

In operation, downward movement of the eyelid control rod 19 causes the upper eyelid 16 to be moved downward to the dotted line position A shown in FIG. 6. This downward movement of the rod 19 also moves the pivot pins 45 downward as shown by the dotted line to rotate link 41 about the fixed pivot pin 46 into the dotted line position. This causes link 41 to raise the pivot pin 44 and also control rod 39, as shown in dotted line, thereby raising the plate for the lower eyelid 18. In this manner, the simple downward movement of the handle 20 causes the eyelids 16 and 18 to move together from an open position to a closed position simulating the closing of the eyes. It is noted that the plate for the upper eyelid 16 has an upside down, v-shaped edge 48 which abuts or overlaps with a similarly shaped edge 49 on the plate for the lower eyelid 18 when the eyelids 16 and 18 are brought together as described above.

Figure 4:
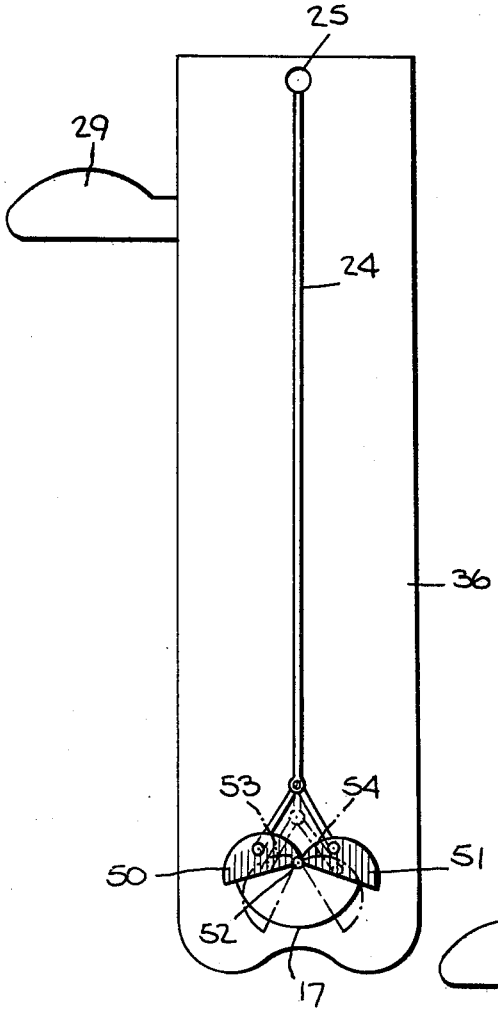
FIG. 4 is a front elevation of the mechanism for controlling the effect on the mouth feature of the character shown in FIG. 1.

Referring to FIG. 4, there is shown the mechanism for controlling the effect on the mouth feature 17 of the character. The mouth feature 17 is constituted by a paint or material attached to rear support plate 36 and having an arcuate shape as shown. The amount by which the mouth feature 17 is expose to the field of view from the front of the character 10 is determined by the position of a pair of semi-circular disks 50 and 51 which are hinged together by a common pivot pin 52 at their inner corners 53,54. Pivot pin 52 is fixedly secured to the rear support plate 36 by means of a support post 55 which forms a part of, or is attached to, the pivot pin 52 (see FIG. 3). Links 56 and 57 are pivotally connected at 58 and 59 to the disks 50 and 51, respectively. The other ends of links 56 and 57 are connected to a common pivot pin 60 which is attached to the control rod 24. In operation, the up and down movement of the control rod 24 by manipulation of handle 25 causes the links 56 and 57 to pivot the disks 50 and 51 about the pivot pin 52, thereby varying the display of the mouth feature 17 on the character simulating a broad smile (FIG. 1) to a relatively narrow mouth (FIG. 7) display produced with the disks 50 and 51 in the dotted line position as shown in FIG. 4.

Referring to FIGS. 8 and 9, there is shown the flexible construction for making arm 26 operate into various configurations. A longitudinal strip of rubber or other flexible material 61 is secured at one end 62 near the shoulder 63 of the character 10 by any conventional fastener 62a such as a nail or screw, while the other end 64 extends into and is attached to a part of the wrist or hand 65 of the character. Attached to the strip 61 is a plurality of short lateral strips 66 of similar flexible material which are secured in crossweave fashion on either side of the strip 61 by alternating the adjacent strips 66 on the front and backsides of the rubber strip as shown in FIG. 9. This crossweave of the short strips 66 permits the adjacent strips to interleave when the longitudinal strip 61 is bent in arcuate form as shown in FIG. 7 and FIG. 8 to simulate the up and down arm and hand movements. The arms and hands 26 can be moved by control rods 27,28 attached to the hands.

Referring again to FIG. 3 front plate 13 which is exposed to the field of view is connected to rear support plate 36 by means of at least four mounting posts 67 (only two shown) attached to the front and rear plates. The eyelids 16 and 18 are mounted in front of the eyeballs 15 to simulate the eye and eyelid movements. Also, the mouth feature 17 is located vertically below the eyelid and eyeball features. Front plate 12 includes the fixed facial features and the outlines of the character, such as the head and the hair line 68, the eyebrows 69, the nose 70 and the ears 71. Also, two generally egg-shaped openings 72 and 73 are provided through the front plate 12 so that the eyelids 16,18 and eyeball features 15 can be viewed behind the openings 72 and 73. The front plate 12 may include a transparent or open portion 74 such that the mouth feature 17 can be viewed. For this purpose, the space 74 in the face area is essentially open and may be provided by having side supports 75,76 extending down to join the face portion 77 with neck portion 78.

Although the above description is directed to the certain embodimens of the invention, it is noted that other variations and modifications will be apparent to those skilled in the art and, therefore, may be made without departing from the spirit and scope of the present invention.

What is claimed is:

1. An animated puppet comprising:

support means for mounting a plurality of facial features of said puppet including the eyelids, eyeballs and mouth thereof;

an upper plate and a lower plate movably mounted on said support means for simulating the respective upper and lower eyelids of said puppet;

eyeball background plate means pivotally mounted on said support means in association with said upper and lower plates and having a pair of eyeball features thereon;

eyeball control means for moving said background plate means from side to side an up and down;

mouth background means mounted on said support means and having a mouth feature thereon;

mouth plate means connected to said support means for viewing in front of said mouth background means, said mouth plate means being laterally expandable and retractable to expose varying positions of said mouth feature;

whereby said puppet is provided with movable eyeballs and eyelids and a variable mouth feature.

2. The apparatus of claim 1 including eyelid control means interconnecting said upper and lower plates for moving said plates in a substantially up and down direction between a first position in which said plates are separated to expose said eyeball features and a second position in which said plates are in contact with one another to cover said eyeball features.

3. An animated puppet as recited in claim 2 wherein said eyelid control means include a first control rod connected to said upper plate, a second control rod connected to said lower plate, pivot linkage means interconnecting said first control rod with said second control rod such that the vertical movement of one control rod causes the other control rod to move vertically in the opposite direction, thereby simulating the opening and closing of the eyes.

4. An animated puppet as recited in claim 3, wherein said pivot linkage means comprises a rigid bar which is pivotally mounted near its central portion on a fixed pivot support, and means at both ends of said bar for respectively connecting said bar to said first and second control rods.

5. An animated puppet as recited in claim 4, wherein said means for connecting said bar to said first and second control rods comprises pivot means.

6. An animated puppet, comprising:

means for supporting a plurality of facial features of said puppet;

a mouth background means having a mouth feature thereon;

said puppet including a portion through which said mouth feature may be viewed from the front of said puppet.

means for varying the display of said mouth feature, said varying means including a pair of plates mounted in front of said mouth background means at a location which covers the field of view of at least a portion of said mouth feature;

control means connected to said plates for moving said plates between a first position which exposes the full mouth feature and a second position which covers the sides of said mouth feature to expose only a small central portion thereof;

whereby the movement of said plates provide the simulation of a broad smile of said puppet.

7. An animated puppet as recited in claim 6, wherein said pair of plates are pivotally mounted on a support post attached to said support means.

8. An animated puppet as recited in claim 7, wherein said pair of plates each have a semi-circular disk shape, and said pair of plates are pivotally mounted on a common fixed support post attached to said support means.

9. An animated puppet as recited in claim 8, wherein said control means includes a control rod means attached to each of said plates for moving said plates in front of said mouth background means.

* * * * *